US007159711B1

(12) United States Patent
Gardner

(10) Patent No.: US 7,159,711 B1
(45) Date of Patent: Jan. 9, 2007

(54) CASE FOR TRANSPORTING HANDGUNS

(75) Inventor: John D. Gardner, McKinney, TX (US)

(73) Assignee: Grassburr Leather Works, Inc., McKinney, TX (US)

( * ) Notice: Subject to any disclaimer, the term of this patent is extended or adjusted under 35 U.S.C. 154(b) by 380 days.

(21) Appl. No.: 10/886,234

(22) Filed: Jul. 7, 2004

(51) Int. Cl.
*B65D 85/00* (2006.01)

(52) U.S. Cl. ..... 206/317; 206/736; 206/751; 206/754; 206/756; 206/759; 206/315.11; 211/64; 248/226.11

(58) Field of Classification Search ..... 206/735, 206/736, 738, 739, 742, 751–759, 317, 315.11, 206/804, 349, 555, 774, 767; 211/64; 248/101, 248/205.1, 226.11, 229.1, 229.14, 309.1, 248/311.2; 102/464
See application file for complete search history.

(56) References Cited

U.S. PATENT DOCUMENTS 3,858,693 A * 1/1975 Dubenko ..... 190/16
4,309,065 A * 1/1982 Pappas ..... 312/242
4,548,392 A * 10/1985 Rickling ..... 269/156
5,118,175 A * 6/1992 Costello ..... 312/242
5,168,994 A 12/1992 Beletsky et al.
5,671,830 A * 9/1997 Wood ..... 190/101
6,405,861 B1 6/2002 Siler et al.
6,570,501 B1 * 5/2003 Bushnell et al. ..... 340/542
6,843,081 B1 * 1/2005 Painter ..... 70/63

* cited by examiner

*Primary Examiner*—Mickey Yu
*Assistant Examiner*—Steven Pollicoff

(57) ABSTRACT

The present invention provides for a case for transporting handguns and methods of using and manufacturing the same. In one embodiment, the case is comprised of (i) an expansion mechanism located within the case, having a mounting bar coupled thereto and configured to deploy the mounting bar as the case is opened; and (ii) a handgun holder coupled to the mounting bar that includes (a) a clamp configured removably to secure the handgun holder to the mounting bar and coupled to a first shank having a threaded receptacle at an end thereof, (b) a holster seat configured to conform, and coupled, to a handgun holster and further coupled to the side of a second shank having a major axis substantially transverse to a longitudinal axis of the handgun holster, an end of the second shank mating with the end of the first shank, and (c) a fastener configured to pass through an opening through the second shank along the major axis and engage the threaded receptacle.

20 Claims, 4 Drawing Sheets

GBUR 0001

CASE FOR TRANSPORTING HANDGUNS

TECHNICAL FIELD OF THE INVENTION

The present invention is directed, in general, to a case for transporting handguns and, more specifically, to a case for transporting one or more handguns with an expansion mechanism within the case configured to deploy a mounting bar with handgun holders thereon when the case is opened.

BACKGROUND OF THE INVENTION

A number of cases are commercially available for transporting firearms. In the case of handguns, the majority of these consist of a sturdy briefcase or medical bag size case filled with a foam or compressible rubber type material that cushions and protects handguns contained therein. Frequently the foam or rubberized material is cut out or molded to form a handgun shaped recess.

Most of these prior art handgun transportation cases are adequate and generally suitable for carrying one or more handguns from one place to another. However, such cases do have a number of limitations. One such limitation is the number of handguns that can be carried in such a prior art case. The interior space for carrying handguns is limited by the foam or rubberized material necessary to cushion and protect the handguns, which will generally take up most of the case's interior space. Of course, this is a necessary limitation in order to protect any handguns in from being damaged. If this type of cushioning material was not in the case, handguns therein would not be secure and would be susceptible to damage.

In addition to being used for the general transportation of handguns, handgun cases for specialized purposes are also commercially available. For example, specialized cases are available to competitive target shooters. These prior art cases are constructed to carry a number of handguns by utilizing interior structures that limit the movement of the guns within the case. Most of these cases, however, only secure the handguns when the case is carried or transported in an upright position. If the case is turned on its side or upside down the guns are susceptible to falling out of their racks. These cases also typically have sufficient space within them to accommodate a variety of the other accouterments used by a competitive handgun shooter. There will generally be sufficient space to carry ammunition, cleaning supplies, and safety equipment such as shooting glasses and hearing protection. Most such cases also have space within them for a spotting scope, which can be either mounted to the case itself or be located in a compartment within the case together with a stand for mounting it. Because handguns in these cases are generally not as secure as they would be in cases where foam or a rubberized material is used to protect the handguns, they are generally not suitable for the shipment or air transport of handguns. Most competitors will generally utilize a foam lined case of the first type described to transport firearms to a competitive even and ship the competition box separately with the necessary shooting gear contained therein.

Accordingly, what is needed in the art is a handgun transportation case that can securely accommodate and transport a number of handguns within a limited space and that provides a user convenient access to any handguns therein when the case is opened.

SUMMARY OF THE INVENTION

To address the above-discussed deficiencies in the prior art, the present invention provides for a case for transporting handguns and methods of using and manufacturing the same. In one embodiment, the case is comprised of (i) an expansion mechanism located within the case, having a mounting bar coupled thereto and configured to deploy the mounting bar as the case is opened; and (ii) a handgun holder coupled to the mounting bar that includes (a) a clamp configured removably to secure the handgun holder to the mounting bar and coupled to a first shank having a threaded receptacle at an end thereof, (b) a holster seat configured to conform, and coupled, to a handgun holster and further coupled to the side of a second shank having a major axis substantially transverse to a longitudinal axis of the handgun holster, an end of the second shank mating with the end of the first shank, and (c) a fastener configured to pass through an opening through the second shank along the major axis and engage the threaded receptacle.

The present invention thus provides for a handgun transportation case wherein each handgun is individually secured in its own handgun holder. When the case is closed the expansion mechanism folds the mounting bar on which the handgun holder or holders, as the case may be, into the case to provide for compact storage and convenient transportation. When the case is opened, the expansion mechanism deploys the mounting bar from within the case to conveniently present the user with the handgun holders together with any handguns contained therein.

Another embodiment of the invention provides for the end of the first shank and the end of the second shank to be grooved such that the grooves in the end of the first shank mate with the grooves in the end of the second shank. As will be hereinafter explained, this embodiment provides for improved security of a handgun placed in the handgun holder because it prevents slippage between the shanks. It also permits, in one embodiment, the angle of the handgun holder to be adjusted.

In another embodiment, the handgun holder can be adjustably positioned on the mounting bar. This permits a user to position the handgun holder so as to maximize the use of space within the case. For example, if only one handgun is being transported, the handgun holder can be positioned at one end of the case leaving the rest of the space in the case available for carrying other items, such as hearing and eye protection devices, ammunition, and so forth. In still another embodiment of the invention, a plurality of handgun holders are coupled to the mounting bar. When a plurality of handgun holders are used, the invention permits a user to advantageously adjust handgun holders on the mounting bar based on the number of handguns to be carried. For example, a gun collector concerned with scratching or bumping handguns against one another can position the handgun holders to provide for an abundant amount of space between holders. On the other hand, a dealer traveling to a gun show may want to carry as many guns as possible and will crowd the handgun holders close together to squeeze as many guns into the case as possible.

In yet still another embodiment of the invention, both ends of the second shank are grooved. This embodiment permits the handgun holder to be reversed within the case.

In another embodiment of the invention, the holster seat, the first shank and the second shank are metallic. In yet another embodiment a protective covering is placed over the holster seat.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
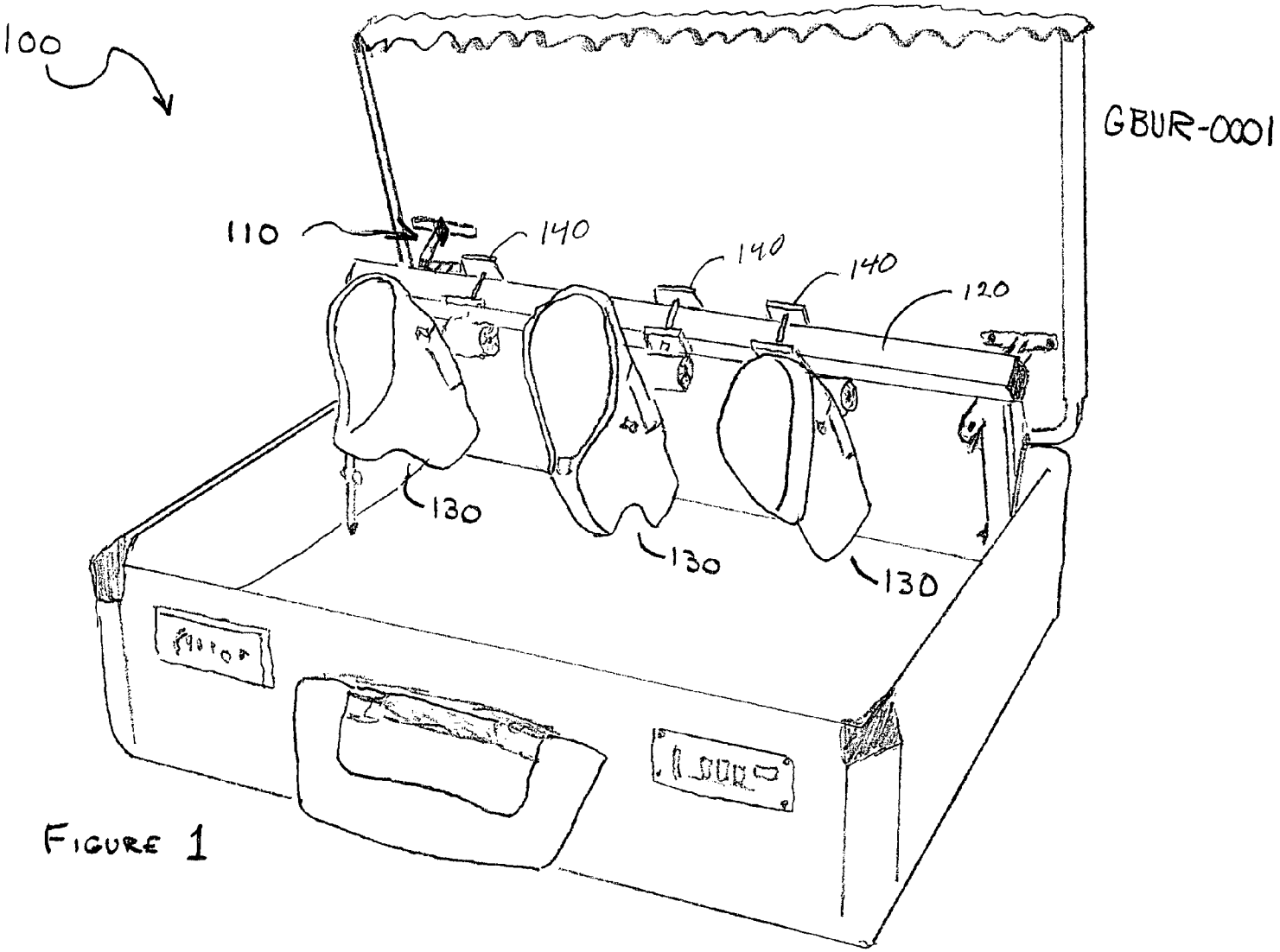
FIG. 1 illustrates an isometric view of a handgun case for transporting handguns that is constructed in accordance with the present invention.

Referring initially to FIG. 1 illustrated is an isometric view of a case 100 for transporting handguns constructed in accordance with the present invention. An expansion mechanism 110 with a mounting bar 120 is located within the case 100. The expansion mechanism 110 is configured to deploy the mounting bar 120 as the case 100 is opened. The case 100, shown in the open position with the mounting bar 120 deployed, folds the expansion mechanism 110 inside the case 100 as it is closed. Coupled to the mounting bar 120 are handgun holders 130, which can be a single handgun holder 130 or, as shown in the illustrated embodiment, a plurality of handgun holders 130. Each handgun holder 130 is coupled to the mounting bar 120 by a clamp 140. A user can use the clamp 140 to adjust the position of the handgun holder 130 on the mounting bar 120.

Figure 2A:
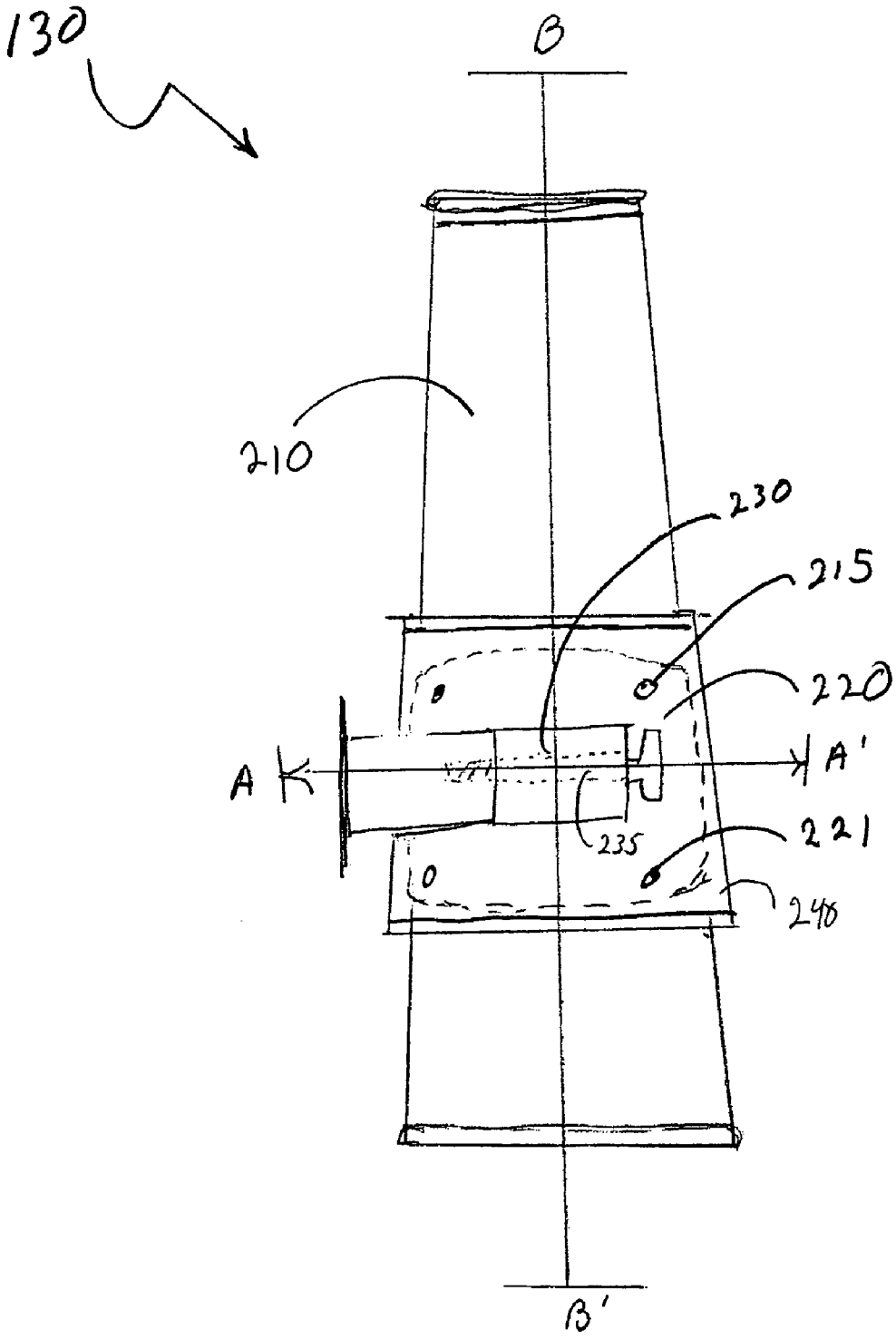
FIGS. 2A and 2B, respectively, illustrate a planar top view and an end view of a handgun holder constructed in accordance with the present invention.
Figure 2B:
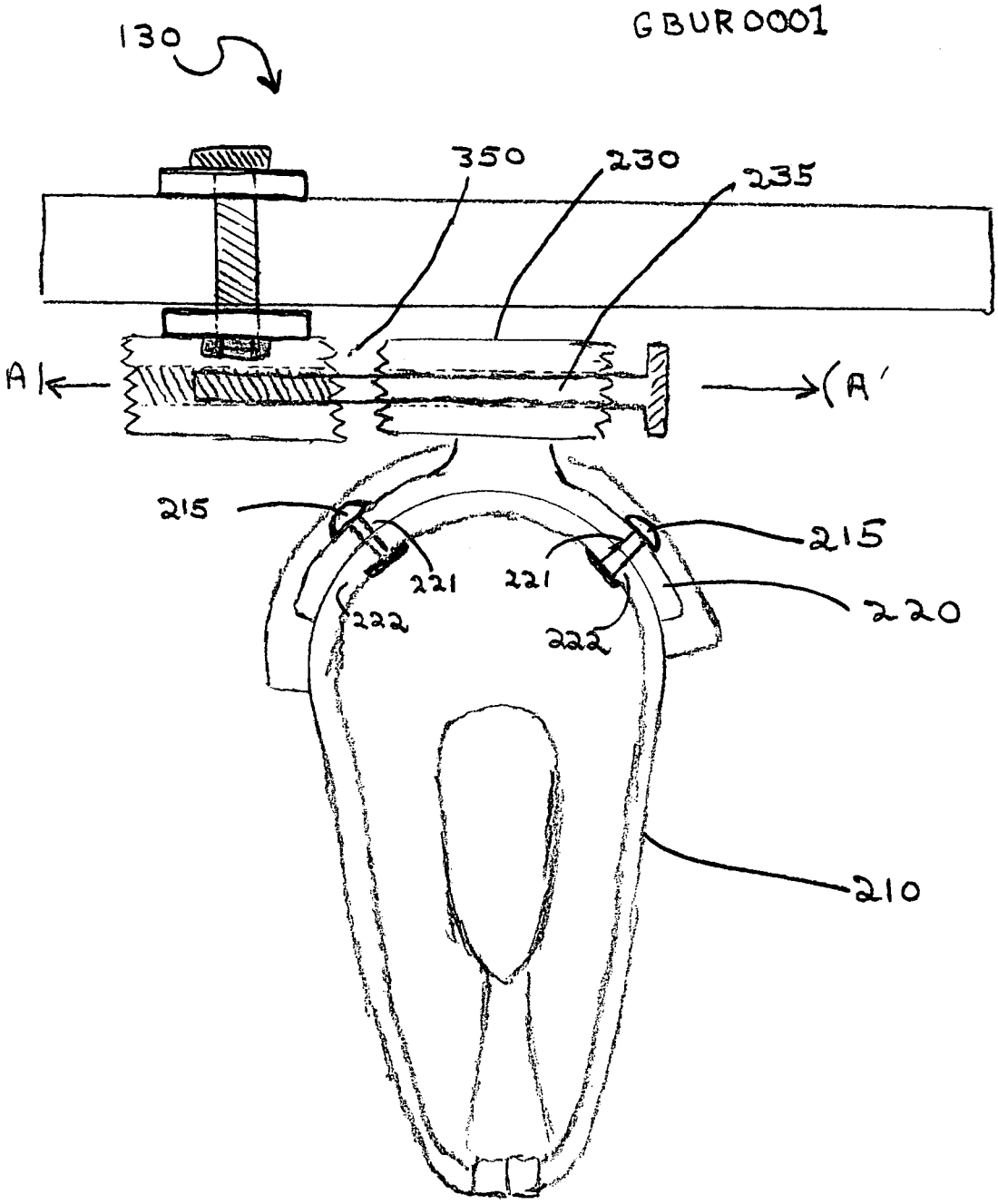

Turning now to FIGS. 2A and 2B, FIG. 2A illustrates a planar top view and FIG. 2B illustrates a planar end view of a handgun holder 130 constructed in accordance with the present invention. The handgun holder 130 is constructed with a holster 210 for a handgun coupled to a holster seat 220. The holster seat 220 is configured to conform to the shape of the holster 210, which in the illustrated embodiment is curved to conform to the top of the holster 210. The holster seat 210 and holster can be coupled using any method known to those of ordinary skill in the pertinent art. In the instant case, rivets 215 are used. The rivets 215 pass thru holes 221 in the holster seat 220 that match corresponding holes 222 in the holster 210. Of course the holster seat 220 could be fastened to the holster 210 using glue, other mechanical fastener types, or any other method and still be within the intended scope of the present invention.

On the side opposite the holster 210, the holster seat 220 is coupled to the side of a second shank 230 (the first shank is hereinafter described). In one embodiment of the invention the holster seat, first shank and second shank are metallic. This permits, as shown in the illustrated embodiment, the holster seat 220 and second shank 230 to be coupled together with a weld, although any means or method of coupling may be used and still be within the intended scope of the present invention. For example, the holster seat 220 and the second shank 230 to be made as a single unit by machining or casting and still be within the scope of the intended invention. The second shank 230 is coupled to the holster seat 220 so that when the holster seat 220 is coupled to the holster 210, a major axis A–A' of the second shank 230 will be substantially transverse to a longitudinal axis B–B' of the handgun holster 210. Also shown in this embodiment is an opening 235 thru the second shank 230 along its major axis A–A'.

Figure 3:
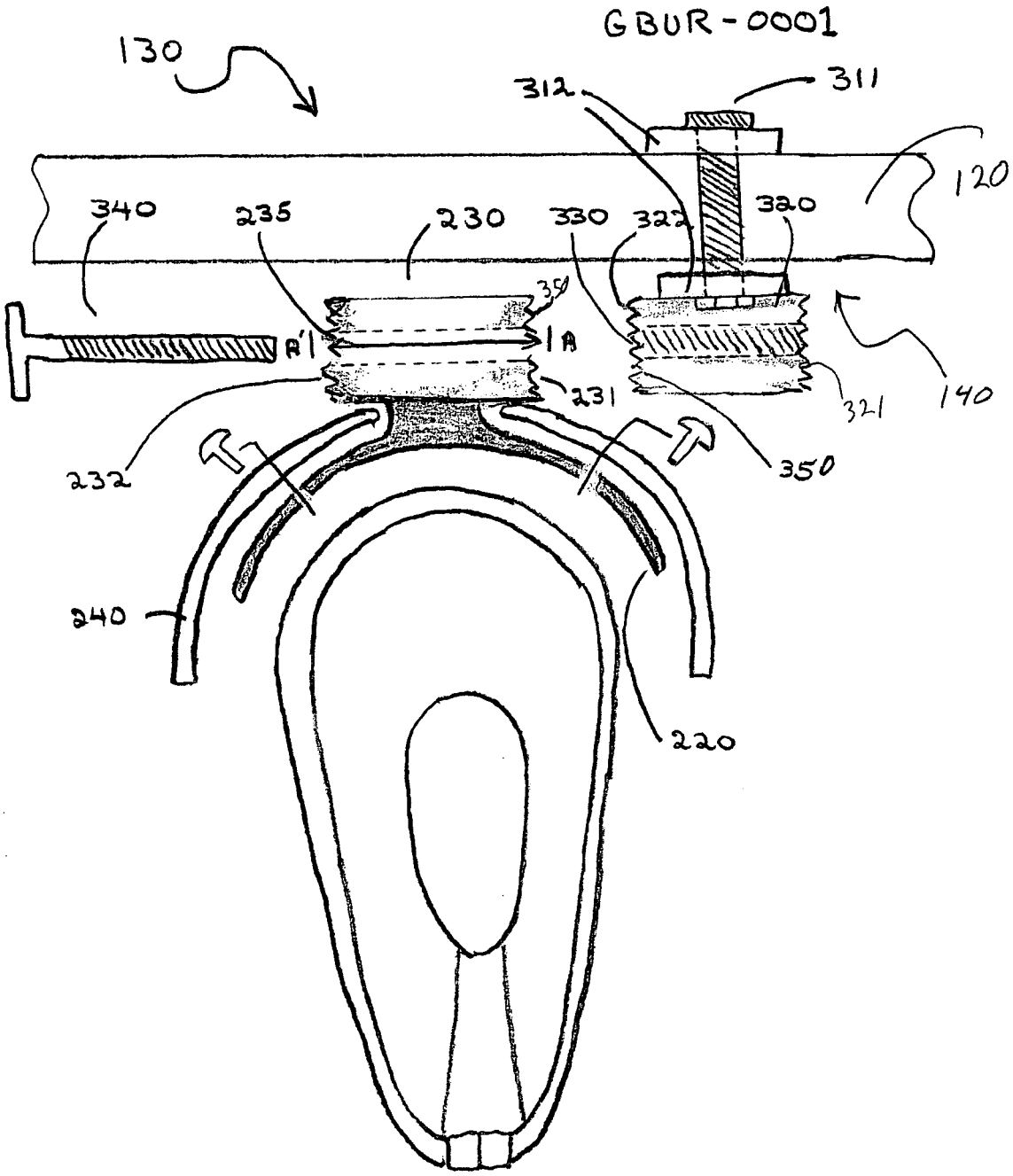
FIG. 3 illustrates a partially exploded planar end view of one embodiment of a handgun holder constructed in accordance with the present invention.

Turning now to FIG. 3, illustrated is a partially exploded planar end view of one embodiment of a handgun holder 130 constructed in accordance with the present invention. A clamp 140, configured to removably couple the handgun holder 130 to the mounting bar 120 shown in FIG. 1, is coupled to a first shank 320. Several types of clamp 140 known to those of ordinary skill in the pertinent art can be used and still be within the intended scope of the present invention. For example, the clamp 140 may be removably secured to the mounting bar 120 using a screw 311 to tighten jaws 312 of the clamp 140 about the mounting bar 120. The clamp 140 is coupled to the side of a first shank 320 in the illustrated embodiment, although it could be coupled to an end 321, 322 and be within the intended scope of the present invention. The clamp 140 can be coupled to the first shank 320 by any means known to those of ordinary skill in the art, such as screws, a weld, or glue.

At an end 322 of the first shank 320 is a threaded receptacle 330. The end 322 of the first shank 320 is configured to mate with an end 231 of the second shank 230. A fastener 340, passed through the opening 235 in the second shank 230, engages a threaded receptacle 330 in the end 322 of the first shank 320 to secure the second shank 230 to the first shank 320. In one embodiment of the present invention, both ends 231, 232 of the second shank 230 mate with the distal end 322 of the first shank 320, which embodiment permits the holster seat 220 position to be reversed. In another embodiment of the present invention, both ends 321, 322 of the first shank 230 mate with the ends 231, 232 of the second shank 230, which embodiment permits the holster seat 220 position to be coupled to either end of the second shank 230. In still another embodiment of the invention the ends 231, 232 of the second shank 230 and the ends 321, 322 of the first shank 320 have grooves 350. A mating of grooves 350 in the first shank 320 with grooves 350 in the second shank 230 serve to lock the handgun holder 130 into position. The grooves 350 also permit the position of the holster 210 to be rotationally adjusted. This beneficial embodiment provides for improved security of a handgun placed in the handgun holder 130 because it prevents slippage between the shanks 230, 320 and allows the angle of the holster 210 to be adjusted. The grooves 350 can be any type or form that permit the two shanks 230, 320 to be mated, including, without limitation, notches, a waved surface, teeth, etc.

As previously illustrated, the holster seat 220 is coupled to a holster 210. Referring to FIGS. 2B, 2A and 3, in one embodiment of the invention, a protective covering 240 is located over the holster seat 220. This provides protection to a user from the heads or ends of rivets 215 that may be protruding from the holster seat 220 as well as providing a pleasing and finished look to the handgun holder 130 itself.

Included in the present invention are methods of using and manufacturing a case 100 for transporting handguns.

The above explanation of the case 100 and its various embodiments will sufficiently enable a person of ordinary skill in the pertinent art to use and manufacture the case 100 for transporting handguns described herein.

Although the present invention has been described in detail, those skilled in the art should understand that they can make various changes, substitutions and alterations herein without departing from the spirit and scope of the invention in its broadest form.

What is claimed is:

1. A case for transporting handguns, comprising:

an expansion mechanism located within said case, having a mounting bar coupled thereto and configured to deploy said mounting bar as said case is opened; and a handgun holder coupled to said mounting bar and including:

a clamp configured removably to secure said handgun holder to said mounting bar and coupled to a first shank having a threaded receptacle at an end thereof, a holster seat configured to conform, and coupled, to a handgun holster and further coupled to the side of a second shank having a major axis substantially transverse to a longitudinal axis of said handgun holster, an end of said second shank mating with said end of said first shank, and a fastener configured to pass through an opening through said second shank along said major axis and engage said threaded receptacle.

2. The case for transporting handguns as recited in claim 1 wherein said end of said first shank and said end of said second shank are grooved such that the grooves in said end of said first shank mate with the grooves in said end of said second shank.

3. The case for transporting handguns as recited in claim 1 wherein said handgun holder is adjustably positioned on said mounting bar.

4. The case for transporting handguns as recited in claim 1 wherein a plurality of said handgun holders are coupled to said mounting bar.

5. The case for transporting handguns as recited in claim 1 wherein both ends of said second shank are grooved.

6. The case for transporting handguns as recited in claim 1 wherein said holster seat, said first shank and said second shank are metallic.

7. The case for transporting handguns as recited in claim 1 further comprising a protective covering over said holster seat.

8. A method of transporting a handgun, comprising:

placing a handgun in a case for transporting handguns, said case including:

an expansion mechanism located within said case, having a mounting bar coupled thereto and configured to deploy said mounting bar as said case is opened; and a handgun holder coupled to said mounting bar, said handgun holder including:

a clamp configured removably to secure said handgun holder to said mounting bar and coupled to a first shank having a threaded receptacle at an end thereof, a holster seat configured to conform, and coupled, to a handgun holster and further coupled to a side of a second shank having a major axis substantially transverse to a longitudinal axis of said handgun holster, an end of said second shank mating with said end of said first shank, and a fastener configured to pass through an opening through said second shank along said major axis and engage said threaded receptacle.

9. The method of transporting a handgun as recited in claim 8 wherein said end of said first shank and said end of said second shank are grooved such that the grooves in said end of said first shank mate with the grooves in said end of said second shank.

10. The method of transporting a handgun as recited in claim 8 wherein said handgun holder is adjustably positioned on said mounting bar.

11. The method of transporting a handgun as recited in claim 8 wherein a plurality of said handgun holders are coupled to said mounting bar.

12. The method of transporting a handgun as recited in claim 8 wherein both ends of said second shank are grooved.

13. The method of transporting a handgun as recited in claim 8 wherein said holster seat, said first shank and said second shank are metallic.

14. The method of transporting a handgun as recited in claim 8 further comprising a protective covering over said holster seat.

15. A method of manufacturing a case for transporting handguns, comprising:

locating an expansion mechanism within said case, said expansion mechanism having a mounting bar coupled thereto and configured to deploy said mounting bar as said case is opened; and coupling a handgun holder to said mounting bar, said handgun holder including:

a clamp configured removably to secure said handgun holder to said mounting bar and coupled to a first shank having a threaded receptacle at an end thereof, a holster seat configured to conform, and coupled, to a handgun holster and further coupled to a side of a second shank having a major axis substantially transverse to a longitudinal axis of said handgun holster, an end of said second shank mating with said end of said first shank, and a fastener configured to pass through an opening through said second shank along said major axis and engage said threaded receptacle.

16. The method of manufacturing a case for transporting handguns as recited in claim 15 wherein said end of said first shank and said end of said second shank are grooved such that the grooves in said end of said first shank mate with the grooves in said end of said second shank.

17. The method of manufacturing a case for transporting handguns as recited in claim 15 wherein said handgun holder is adjustably positioned on said mounting bar.

18. The method of manufacturing a case for transporting handguns as recited in claim 15 wherein a plurality of said handgun holders are coupled to said mounting bar.

19. The method of manufacturing a case for transporting handguns as recited in claim 15 wherein both ends of said second shank are grooved.

20. The method of manufacturing a case for transporting handguns as recited in claim 15 further comprising a protective covering over said holster seat.

* * * * *